United States Patent [19]

Wager

[11] Patent Number: 4,575,345

[45] Date of Patent: Mar. 11, 1986

[54] METHOD OF PLAYING WITH DOLLS

[76] Inventor: Jack B. Wager, 80-B Morningside Dr., Albany, Ga. 31705

[21] Appl. No.: 715,729

[22] Filed: Mar. 25, 1985

[51] Int. Cl.[4] ..... A63H 3/16

[52] U.S. Cl. ..... 446/99; 434/262; 446/120; 446/296

[58] Field of Search ..... 446/97, 99, 296; 434/262

[56] References Cited

U.S. PATENT DOCUMENTS 4,194,318 3/1980 Watanabe ..... 446/270 X

FOREIGN PATENT DOCUMENTS 2263226 6/1974 Fed. Rep. of Germany ..... 446/296

*Primary Examiner*—F. Barry Shay

*Attorney, Agent, or Firm*—Charles L. Lovercheck; Wayne L. Lovercheck; Dale R. Lovercheck

[57] ABSTRACT

Two dolls and a method of playing with the dolls is disclosed. The dolls are identical but one is clothed and the other is bandaged. The dolls are made of separable interchangeable parts such that a child can pretend that one or the other doll has been injured and substitute the bandaged parts from one doll for the clothed parts of the other. Both dolls can be played with simultaneously as if both have injuries of any of the various parts of the body.

1 Claim, 3 Drawing Figures

METHOD OF PLAYING WITH DOLLS

REFERENCE TO PRIOR APPLICATION

This is a refiling of patent application Ser. No. 012,144, filed Feb. 14, 1979, now abandoned.

REFERENCE TO PRIOR ART

Applicant is aware of the following prior art:

U.S. Pat. No. 1,272,685 shows a doll wherein some of the parts can be removed to make either a tall doll or a short doll.

U.S. Pat. No. 3,225,489, showing a doll head and replaceable hairdo construction for permitting the hairdo to be readily interchanged.

U.S. Pat. No. 3,419,993 showing a doll with plural interchangeable ethnic features.

U.S. Pat. No. 3,464,146 showing a doll with a rotatable head having interchangeable parts that are held together by magnetic means.

U.S. Pat. No. 3,858,351 which shows a doll with a plastic patch simulating a skin blemish or injury on one surface beneath a first aid film.

French Pat. No. 607,477 which shows separable parts for dolls for making dolls of various physical and facial characteristics.

French Pat. No. 1,506,324 shows an animal that has human, yet separable parts.

None of this prior art shows two identical dolls that could be used to play a game of nursing an injured person.

BACKGROUND OF THE INVENTION

Various articulated dolls and animals are known but none have provided two identical dolls, one bandaged, the other clothed in such a way that a child can play with the dolls wherein a child can substitute various selected sections and pretend that these sections represent parts that have been injured.

STATEMENT OF THE INVENTION

The method of playing with a doll disclosed herein is intended to teach children the importance of safety and care and compassion for injured persons. It will also stimulate an interest in caring for the injured and may even arouse an interest in a career in the health care field.

OBJECTS OF THE INVENTION

It is an object of the invention to provide a toy doll combination.

Another object of the invention to provide a method of playing with a doll combination of a doll made up of two identical articulated dolls.

Another object of the invention is to provide a method of playing with a doll pretending the doll has injured parts.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
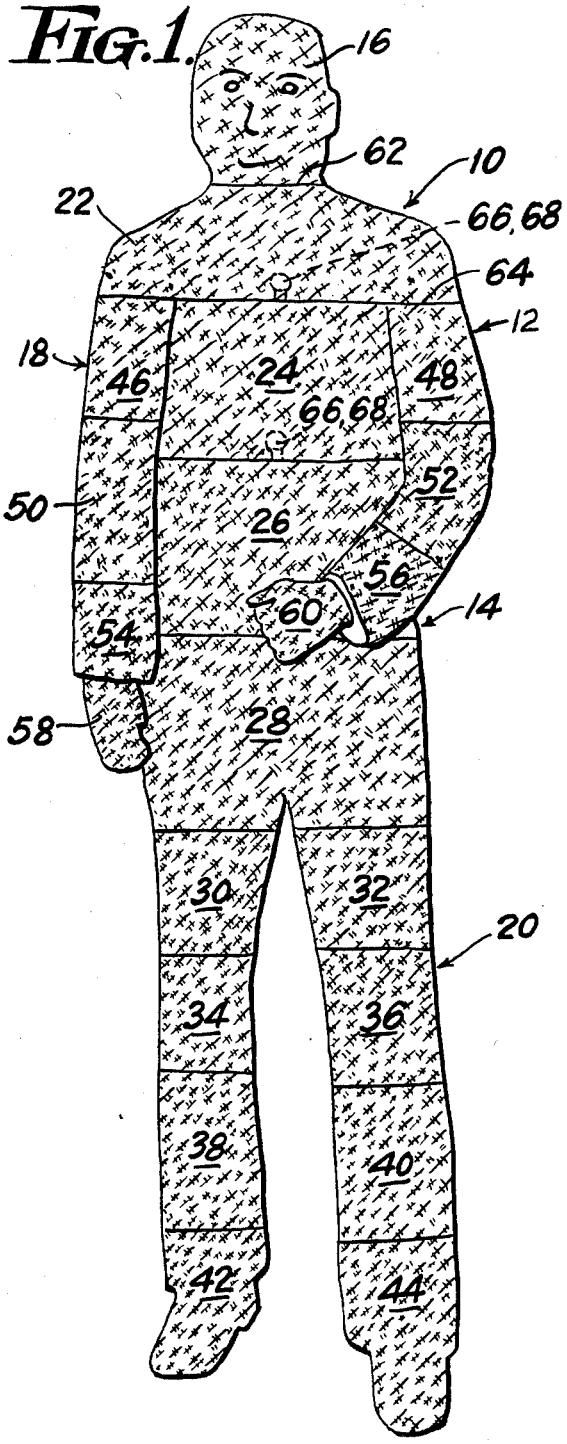
FIG. 1 is a front view of a set of bandaged doll parts according to the invention.
Figure 2:
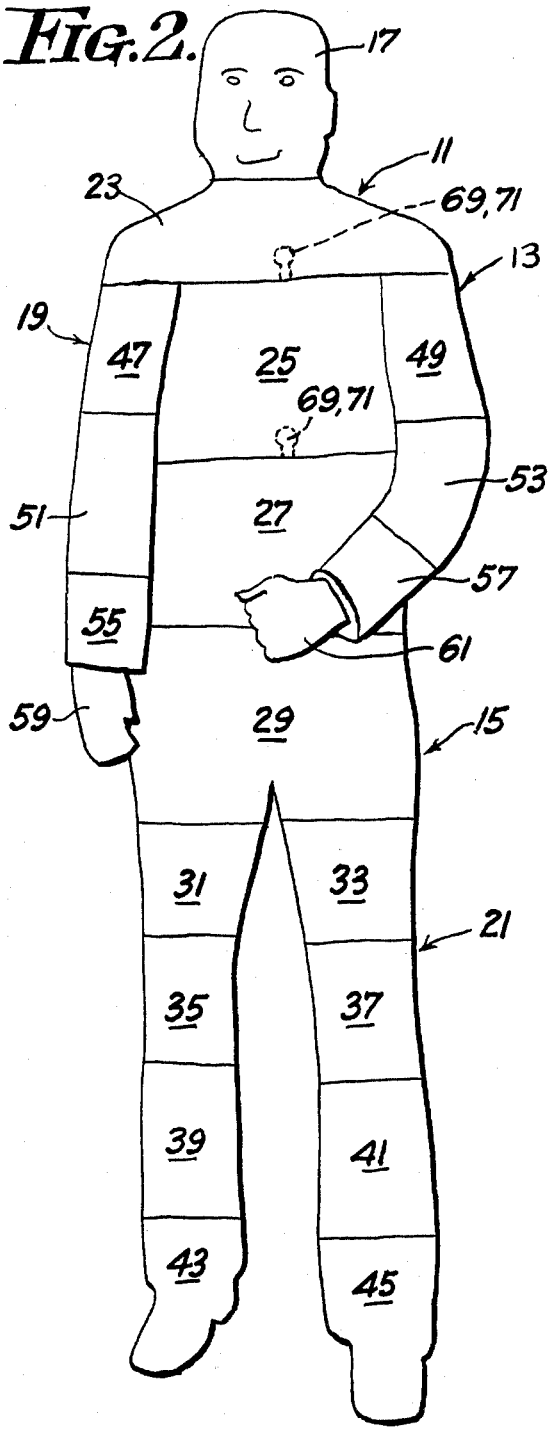
FIG. 2 is a front view of the doll with unbandaged parts, the parts being substantially identical to the first mentioned doll parts.

Now with more particular reference to the drawings, FIG. 1 shows a doll having doll parts that are bandaged that are identical to the parts that make up the doll in FIG. 2, which has unbandaged parts.

FIG. 2 shows a doll with plain clothing and having separable parts that can be removed. The parts of the doll in FIG. 2 are identical to the doll parts shown in FIG. 1 indicated at 10 and 11 respectively. The even numbers generally apply to the bandaged doll parts in FIG. 1 and the odd numbers apply to the doll in FIG. 2, with the unbandaged parts.

The doll parts 10 include a body 12, a torso 14, head 16, arms 18 and legs 20. The torso 14 is made up of shoulders 22, chest 24, abdomen 26 and hips 28. The legs 20 are made up of thighs 30 and 32, knee sections 34 and 36, calf sections 38 and 40, and feet 42 and 44. The arms are made up of biceps 46 and 48, elbows 50 and 52, wrists 54 and 56 and hands 58 and 60.

The doll 11 has a body 13 divided into a torso 15, a head 17, arms 19 and legs 21. The torso is made up of shoulders 23, chest 25, abdomen 27 and hips 29. The legs are made up of thighs 31 and 33, knee sections 35 and 37, calf sections 39 and 41, and feet 43 and 45. The arms are made up of biceps 48 and 49, elbows 51 and 53, wrists 55 and 57, and hands 59 and 61.

The joints between the parts are all flat so that the head rests on the shoulders, the shoulders rest on the chest, the chest rests on the abdomen and the abdomen rests on the hips, the hips on the thighs, the thighs on the knees, the knees on the calves, and calves on feet, with the biceps attached to the shoulders, the elbows attached to the biceps, the wrists attached to the elbows, and the hands attached to the wrists, all with flat joints.

Figure 3:
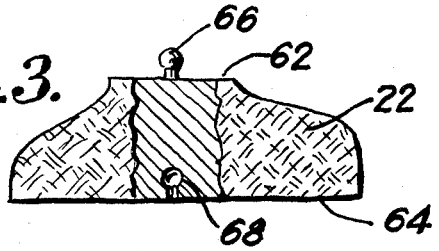
FIG. 3 is a longitudinal cross-sectional view of the shoulder of the doll shown in FIG. 1.

The flat joints between the several parts each have a male headed member on its upper side and are adapted to snap into a complementary-shaped female member on the lower side. The shoulder section 22 is shown in FIG. 3, wherein the shoulder section has a flat upper surface 62 and a flat lower surface 64. The flat upper surface has the headed member 66. Surface 64 has the female opening 68 complementary in size and shape to the headed member 66 so that the male member on the chest section 24 will snap into the opening 68. It will be noted that each part of the body, except the head, has a headed member similar to 66 on the upper surface, and each part of the body, except the feet and the hands, has a female opening similar to 68 on the lower surface which will receive the headed male member. The head, however, has an opening on the bottom to receive the headed member on the upper side of the shoulders, the feet have headed members on the upper sides of the surfaces between the feet and the calves, and the hands have headed members on the upper sides of the surfaces between the hands and the wrists.

The doll in FIG. 2 has parts corresponding to the headed members 69 on the upper side of each part and openings 71 on the lower side of each part. Thus, it is possible to unsnap the shoulders 22, for example, of the doll 10 and replace the shoulders 23 on the doll 11 with the shoulders 22 so that the doll 11 will have bandaged shoulders. The doll 11 and the doll parts 10 can be separated at any of the joints indicated. The corresponding bandaged parts can be substituted for the unbandaged parts of the doll in FIG. 2.

The parts of the doll are made of relatively rigid resilient material such as nylon of a suitable hardness and resiliency, for example, and the parts will be snapped togehter by pintles and openings similar to the familiar popper beads. The plastic used in making the doll and parts will have a suitable hardness and resiliency and the bandaged parts can be selectively substituted for the unbandaged parts thereby simulating injured parts and that are bandaged and the bandaged parts can then be removed.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A method of playing with a doll comprising:

providing a first doll and a second doll substantially identical to said first doll, said dolls being made up of articulated sections such that each section of said first doll is interchangeable with the corresponding section of said second doll, said sections, for each said doll, including a head section, a torso section including shoulders, chest, abdomen and hips, arm sections including biceps, elbows, wrists and hands, leg sections including thighs, knees, calves and feet, the top end and the bottom end of said head, torso, arm and leg sections of said first doll being identical to the top end and bottom end of said head, torso, arm and leg sections, respectively, of said second doll, the outside surfaces of said head, torso, arm and leg sections of said first doll being bandaged, simulating injured body parts, the outside surfaces of said head, torso, arm and leg sections of said second doll being clothed, whereby one or more of said bandaged sections can be substituted for corresponding ones of said clothed sections to make up a doll simulating an individual with both uninjured and injured body parts, each said section of each doll being connected to an adjacent section thereof with a flat surface on the one section adjacent a flat surface on the next section, each said flat surface on each said section having means for detachably holding the said sections together, said method further comprising pretending that at least one said section of said second doll has been injured, removing said section pretended to be injured from said second doll connecting the corresponding bandaged section of said first doll to the section or sections of said second doll with which said section pretended to be injured was connected and, treating said second doll as an invalid.

* * * * *